United States Patent [19]

Schmitz-Steger

[11] 4,181,267

[45] Jan. 1, 1980

[54] ARRANGEMENT FOR COMPACT WINDING OF A CONTINUOUSLY FED WIRE

[76] Inventor: Werner Schmitz-Steger, Barkhovenhöhe 27, 4300 Essen 16, Fed. Rep. of Germany

[21] Appl. No.: 899,788

[22] Filed: Apr. 25, 1978

[51] Int. Cl.[2] ..... B65H 65/00; B65H 75/28

[52] U.S. Cl. ..... 242/25 R

[58] Field of Search ..... 242/25 R, 25 A, 18 R, 242/18 PW, 18 A, 47, 77, 77.2, 77.3, 77.4, 78, 125.1

[56] References Cited

U.S. PATENT DOCUMENTS

| | | | |
|---|---|---|---|
| 1,253,330 | 1/1918 | Anfindsen | 242/25 R |
| 1,538,136 | 5/1925 | Prentiss et al. | 242/25 R |
| 3,472,461 | 10/1969 | Fredriksson | 242/25 R |
| 3,527,077 | 9/1970 | Nargang | 242/77 X |
| 3,592,399 | 7/1971 | Woodrow | 242/25 R |
| 3,625,448 | 12/1971 | Griffiths | 242/25 R X |
| 3,831,871 | 8/1974 | Ikegami | 242/25 R |
| 3,895,762 | 7/1975 | Fletcher, Jr. et al. | 242/25 R X |
| 3,994,058 | 11/1976 | Sasaki et al. | 242/25 R X |
| 4,026,483 | 5/1977 | Skalleberg | 242/25 R |

*Primary Examiner*—Stanley N. Gilreath
*Attorney, Agent, or Firm*—Michael J. Striker

[57] ABSTRACT

The arrangement comprises a spool core secured at one end to a driving shaft and having at the other end an annular groove for catching the continuously fed wire to be wound. A hydraulically or electrically controlled pressing ring is arranged for axial movement into the groove to clamp the wire after its introduction into the groove. The flange of the spool adjacent to the groove has an outwardly sloping surface to assist in guiding the wire into the groove and is provided with radial slits in which tiltable arms are supported to be removed into a position perpendicular to the surface of the core.

14 Claims, 5 Drawing Figures

ARRANGEMENT FOR COMPACT WINDING OF A CONTINUOUSLY FED WIRE

BACKGROUND OF THE INVENTION

This invention relates generally to arrangements for winding continuously fed wires, and more particularly it relates to a reel in the form of a spool having a catching groove for automatically capturing and holding the leading portion of an advancing wire. The catching groove is located at the end of the spool core adjacent the end flange of the spool and extends around the whole periphery of the core.

Reels of this type are capable of accumulating a large amount of wire in minimum space since the individual wire windings lie closely one upon the other and give no chance for the formation of unnecessary empty spaces. Contrary to reeling devices of another type such as for example reels employing rotary baskets, in reels in the form of a spool the problem occurs how to capture reliably the leading parts of the wire advancing at a relatively high feeding speed and how to secure sufficiently fast the wire to the spool so that the slight pull necessary for the satisfactory winding operation could be exerted already at the first winding in order that no wire curls take place and a correct winding pattern might result.

In a conventional reel of this type the flange of the spool remote from the driving unit is supported eccentrically relative to the core of the spool so that an arcuate gap having a wedge-like shape results between the upper surface of the spool core and a recess in the eccentrically supported flange of an increased diameter. This gap is used as a catching groove or notch for the leading portion of the wire. To introduce the leading portion of the wire into the catching groove, a guiding device in the form of a shaped funnel is arranged in the winding area of the spool and is operable for being removed out of this area as soon as the leading portion of the wire is captured in the groove. The clamping of the wire is supposed to be effected by the wedge-like shape of the catching groove as soon as the leading portion of the wire is introduced through the funnel-like device into the groove. This action however, necessitates that the feeding speed of the wire be higher than the peripheral speed of the spool in the catching point.

The essential disadvantage of this known construction is in the fact that the introduction of the wire into the gap and subsequent clamping are subject to frequent failures and such misfunction results in considerable operational disturbances since the entire reeling device has to be stopped. Operational problems of this kind result for example from the fact that the leading portion of the wire is not properly intercepted by the relatively small opening of the funnel-like guiding means or that the wire fails to be captured in the catching groove because the speeds of the reel and the cooperating devices are not exactly synchronized. Another source of trouble is the funnel-like guiding or introduction device that has to change the direction of travel of the incoming wire whereby the wire is abruptly braked. This abrupt braking of the wire produces uncontrollable deflecting movements that in turn assist in curl or loop formations. The main source of disturbances however should be seen in the fact that the clamping of the wire in the wedgelike catching groove is possible only then when the wire enters the groove in tangential direction. This action however presumes that in the moment of the start of the winding operation the rotational speed as the circumference of the spool is lower than the feeding speed of the wire and consequently the wire in the moment of its clamping is again strongly braked and this condition again brings about the danger of lateral deviations and curling. This danger is not removed by immediate accleration of the spool for attaining the desired synchronization or a moderate pull. In any case the prior art reels require an extremely exact speed control that in practice is difficult to fulfill especially in rough conditions of metallurgical operation where one can hardly rely upon the necessary reliability of the control devices especially in the case of high wire feeding speeds over 10 meters per second.

In another known design of reels the catching groove is made circular to completely surround the periphery of the spool core. This known catching groove however is recessed in axial direction of the spool core. The groove is not wedge-shaped but its width corresponds to the diameter of the wire. The wire is supposed to be arrested in the groove by the action of centrifugal force that urges the leading portion of the wire radially outwardly against a side wall of the axially extending catching groove. Even in this known construction the clamping process is unreliable especially in low speeds when centrifugal force is weak. Moreover, the leading portion of the wire has to be introduced at a sharp angle relative to the axis of the spool in order that it might actually enter the axially extending catching groove. Due to this strong inclination of the wire the latter is again suject to braking. Another disadvantage of this known device is caused by the constant width of the catching groove because only one wire with a predetermined diameter can be wound. In addition, the spool in this construction cannot have flanges so that only a small amount of wire can be wound up thereon.

SUMMARY OF THE INVENTION

The primary object of this invention is therefore to provide an arrangement that avoids the aforementioned disadvantages of the prior art.

A particular object of this invention is to provide a spool-type reel in which the leading part of the wound wire is reliably captured and clamped.

Another object of this invention is to provide a reel that is suitable for operation at high as well as at low speeds of feeding.

In keeping with these objects, and others which will become apparent hereafter, one feature of the invention resides, in a spool-type reel, in a combination which comprises an annular groove extending around the periphery of the spool core adjacent a flange of the reel remote from the driving unit and clamping means operable to move in the axial direction into the groove to clamp the wire against one of the walls of the groove. The clamping means includes preferably a clamping ring arranged for axial movement at a center part of the flange and being supported for rotation on a stationary bearing pin.

In this manner all troubles related to the introduction of the wire into the groove are removed because the wire fed in tangential direction relative to the spool core has a tendency to fall due to its own weight into the catching groove provided in the corner between the spool core and the flange. For this purpose, the surface of the spool flange is inclined outwardly so that it guides the wire into the groove. The guiding of the wire can be accomplished by conventional guiding means without any additional modification and costs. Another especially valuable advantage of this invention resides in the fact that wire that is continuously fed in tangential direction can pass through the catching groove without any change of its feeding direction and can be advanced past the spool core for an arbitrarily long time period without being braked or blocked. There is also the possibility to use the reel of this invention not for winding the wire on the spool but for chopping it into short pieces by means of a chopping device provided behind the spool core. This chopping operation may be required for example in the case when the fed wire for one reason or another is unusable and should not be wound up. Moreover, another advantageous possibility in the reel of this invention is to clamp the fed wire into the catching groove only then when the spool has acquired the necessary rotational speed. As long as the speed has not yet been attained, the leading portion of the wire can freely travel through the catching groove without the necessity to stop the cooperating installations or devices. As soon as the spool has attained the required synchronization the wire can be clamped and the winding process can be initiated. The leading part of the wire that in the meantime has advanced past the reel can at the moment of clamping be cut off by an additional shearing device so that it does not disturb the winding operation. In normal situations, care is taken that the reel always rotates with the necessary speed before the beginning of the wire is introduced and that a slight pull be exerted against the wire so that any curl formation is prevented and a correct winding process is secured. Of course effort is always made to reduce waste to a minimum and to keep the cut off part of the leading portion of the wire as short as possible. This requirement is fulfilled by the synchronization of the reel with the feeding speed before the leading part of the wire enters the groove and immediately after the moment of entering the groove the clamping means are actuated to arrest the wire in the groove. Further advantages of the reel of this invention result from the fact that the catching of the wire in the groove is independent from unpredictable frictional or centrifugal forces. Instead, the clamping operation is carried out by reliably controllable clamping elements so that the reel at the beginning of the winding process need not to be stopped in order to clamp therein a new wire. Furthermore the diameters of wires wound on the reel of this invention can vary within broad limits and also various materials can be wound by means of the reel of this invention and also the catching arrangement does not affect the flanges so that the wound roll may have as many layers as defined by the diameter of the flanges. Moreover, the reel of this invention permits the application of very high winding speeds and the aforementioned synchronization troubles occurring in the conventional constructions especially in the moment of arresting the beginning of the wire do not take place. Finally, no feeding direction change is needed for the leading portion of the wire when it is introduced into the catching groove so that all troubles connected with such a direction change are avoided.

Even if in most cases it is preferable to make the catching groove in the range of the corner between the spool core and the flange it is principally also possible to make the catching groove in another section of the spool core.

In the preferred embodiment, the clamping ring or clamping segments are controlled pneumatically or electromagnetically because such control uses control devices that are particularly fast and consequently they enable to reduce to minimum the length of the wasted leading part of the wire behind the point of clamping. As a result, the amount of the waste wire is negligible and the cut-off pieces can be remelted or can be used as test samples.

As known, it is preferable to locate the wire catching device at the end of the spool remote from the main driving unit of the reel. This arrangement brings about structural advantages such as more room for the catching device and its control units.

In order to cut off the excessive wire that has been advanced past the point of clamping, it is particularly advantageous when the flange adjacent to the clamping device is provided with one or more shearing tools arranged on the periphery of the flange and cooperating with a stationary counteracting shearing tool. This arrangement makes it possible that the leading portion of the wire projecting behind the spool core is automatically cut off so that it does not interfere with the winding operation. If desired it is possible to arrange the shearing tools closer to the spool core so that the projecting lead-in section of the wire can be made still shorter.

In a further embodiment of the invention the surface of the spool flange is sloping from the spool core outwardly and the shearing tools arranged on the periphery of the flange project to the level of the central part of the flange. A pressing roller is tiltably arranged near the sloping surface of the flange and is adapted for being swung into a position in contact with the sloping surface to the flange to assist in guiding the wire into the catching groove and to prevent the cutoff portion of the wire from entering into the winding area of the spool. The tilting surface of the flange enables the shearing tools to be out of the range of winding on the spool core and at the same time insures a reliable shearing of the excessive leading wire.

In still another embodiment of this invention the two flanges of the spool are provided with a plurality of radial slits used in binding the completed wire roll and at the same time they accommodate radially directed tiltable abutment levers that are actuated to take an inclined position in alignment with the inclined surface of the flange and alternatively, an upright position at right angles with respect to the axis of rotation of the spool and in alignment with the tips of the shearing tools. The inclined position of the abutment levers is maintained during the introduction of the wire into the catching groove and in this position the excess leading portion of the wire is reliably directed to the shearing assembly. Upon the shearing of the excess part of the wire, the abutment levers are set into their upright position with respect to the spool core so that the winding in the end region of the core is always perpendicular to the axis of rotation.

It is also advantageous to employ the shearing assembly as a wire chopping device so that any additional wire cutting means in the range of the reel of this invention become unnecessary and a further economic advantage is achieved. Nonetheless, it is also possible to dispense with the shearing edges arranged on the spool flange and to provide instead a conventional shearing device arranged in known manner outside the range of the spool on the side opposite to the feeding site.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
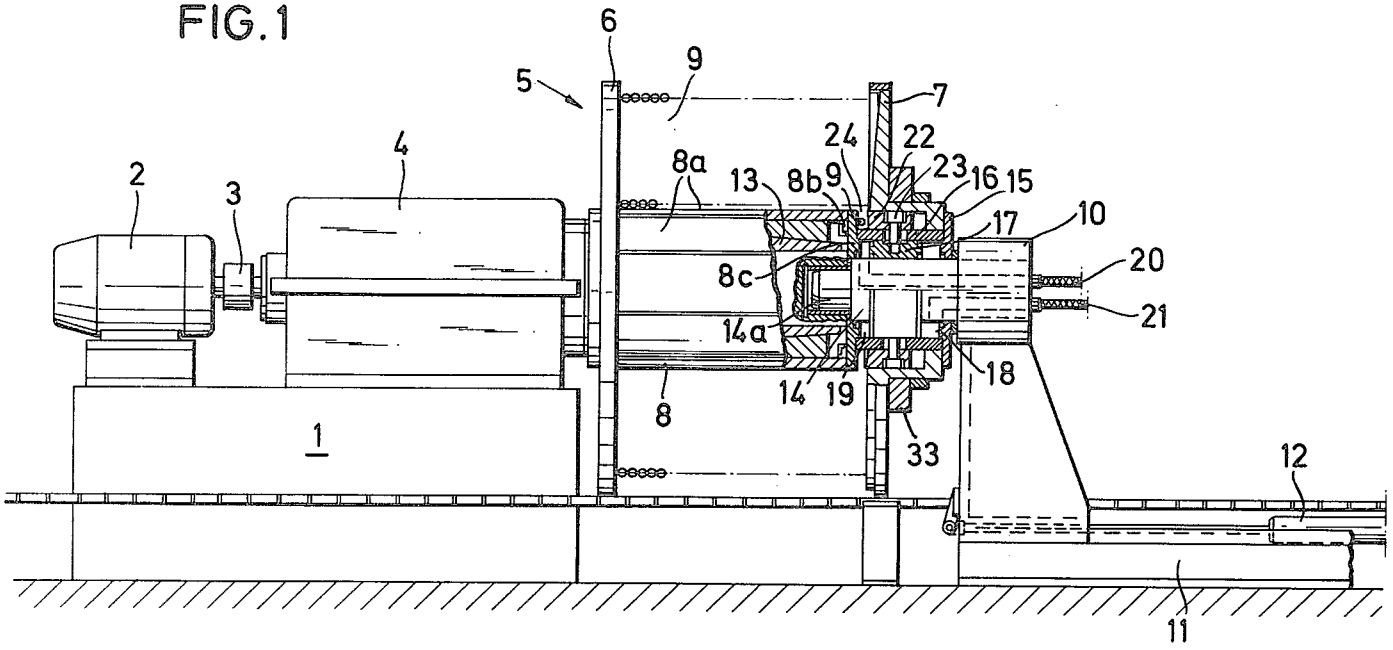
FIG. 1 is a front elevation view, partly in section of the reel of this invention.

The reel in the embodiment as illustrated in FIG. 1 includes a foundation 1 supporting an electromotor 2 and a transmission gear unit 4 coupled to the electromotor by a coupling 3. The driving shaft of the transmission gear unit 4 serves as a driving support for flange 6 and core 8 of spool 5 that also includes a disconnectable second flange 7 as it will be explained below. A continuously fed wire 9 is wound on the spool core 8. The free end of the spool 5 remote from the driving assembly is supported on a bearing stand 10 that can be moved in axial direction relative to the spool 5 on a guiding track 11 and is actuated by a driving cylinder 12 of a suitable hydraulic drive.

Flange 6 near the transmission gear unit 4 is fixedly connected to the spool core 8. The core is composed of a plurality of axially directed cylindrical segments 8*a* that are forced in engagement with each other in radial direction by means of wedges 13. Upon the removal of those wedges the core can be disassembled. The wedges 13 are driven in axial direction into the interior of the spool core 8 by a device which is known per se in the art.

The bearing stand 10 includes a bearing pin 14 projecting in axial direction toward the spool 5. The free end portion 14*a* of the bearing pin 14 is reduced in diameter and supports the free end of the spool core 8 remote from the driving unit 4. The bearing pin 14 slidably supports end flanges 8*c* and 15 of a cylindrical sleeve 16 surrounding the pin 14 and tightly supporting the spool flange 7. The peripheral portion of the sleeve flange 8*c* is provided with teeth engageable into corresponding teeth 8*b* at the free end of the spool core 8 so that the driving units 2, 3 and 4 imparts its rotatable movement via the core 8, the meshing teeth 8*b* and the sleeve 16 to the flange 7. This disconnectable arrangement of the flange 7 serves for the removal of the completed wire roll 9. The disconnection of the flange 7 together with the sleeve flanges 8*c* and 15 is effected by the axial movement of the bearing stand 10 on the guiding track 11 away from the core 8. In the resulting interspace the completed wire roll 9 can be comfortably removed from the core 8.

According to this invention, the bearing pin 14 slidably supports an annular piston 17 the upper surface of which is in sliding contact with the inner wall of the sleeve 16. The size of the piston 17 in axial direction is smaller than the size of the sleeve 16 so that two annular pressure spaces 18 and 19 result between the piston 17 and respective sleeve flanges 8*c* and 15. The pressure space 18 is connected by means of a pressure fluid conduit 21 and the pressure space 19 by means of a pressure fluid conduit 20 to a pneumatic device so that the axial movements of the piston can be controlled pneumatically. A clamping ring 22 is slidably supported on the upper surface of the sleeve 16 and is fixedly connected to the piston 17 by means of a screw 23 passing through a guiding slot in the sleeve. Normally, the face of the clamping ring 22 is in alignment with the edge of the recessed central portion of the flange 7 and spaced apart from the sleeve flange 8*c* so that an annular groove 24 is created therebetween. This annular groove 24 forms the catch groove for receiving a tangentially fed wire 9. If the piston is moved to the left by the action of pressure air from conduit 21, the clamping piston is also displaced to the left and clamps the wire against the flange 8*c*. As soon as the pressure in pressure space 18 is released and by means of conduit 20 the pressure air is introduced into the pressure space 19, piston 17 and consequently the clamping ring 22 is moved to the right and wire 9 in the groove 24 is released.

Figure 2:
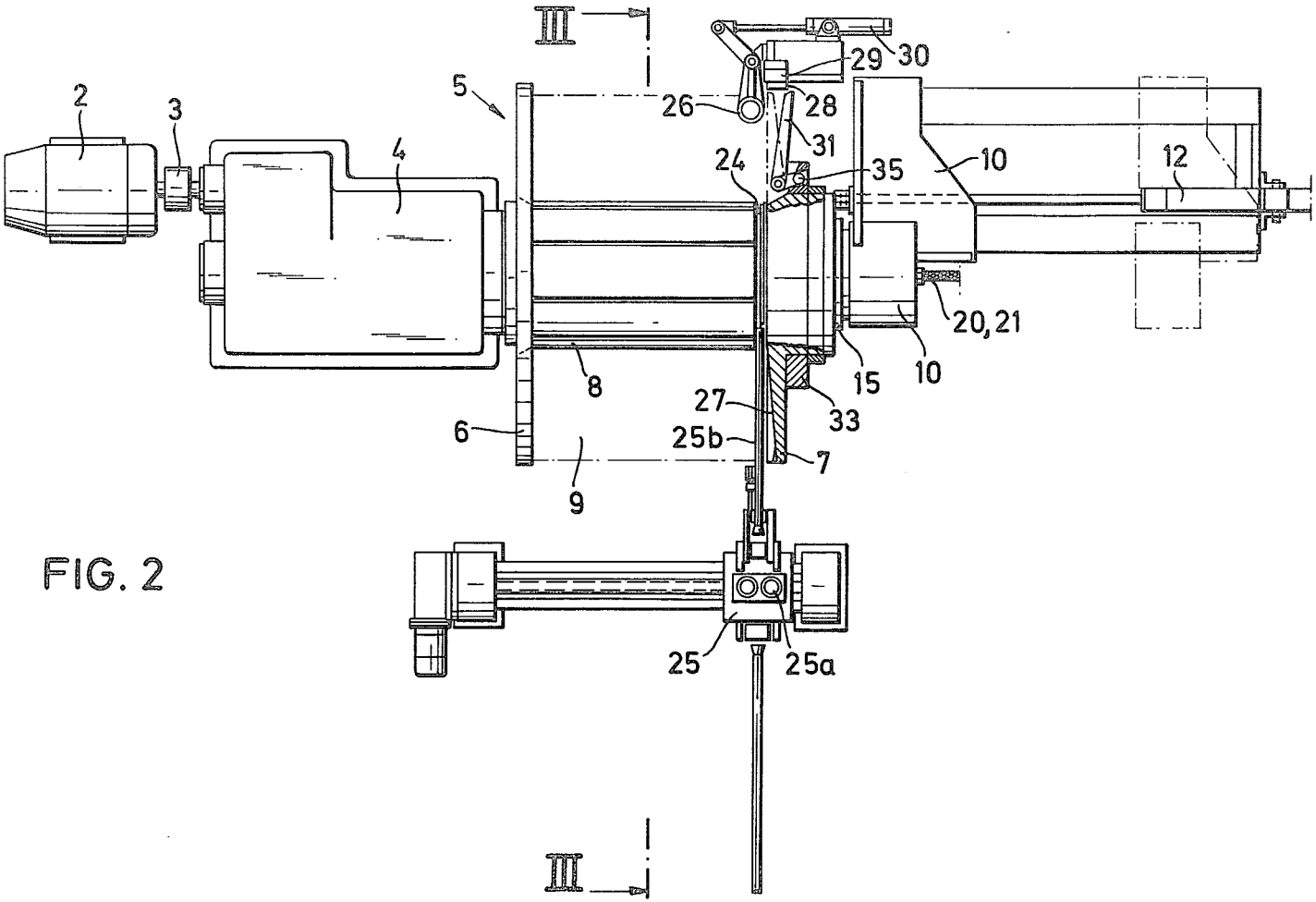
FIG. 2 is a top view, partly in section of the reel of FIG. 1.

As shown in FIG. 2, the conventional wire guiding device 25 leads the wire 9 into the groove 24 located at the end portion of the spool core 8 adjacent the flange 7. To facilitate the introduction of the wire into the groove 24, the surface of the flange 7 is sloping from the core 8 outwardly and wire 9 is pressed against the sloping surface by means of a pressing roller 26 that is pivotably supported outside the range of the spool 5 to disengage the flange 7 when the introduction of the wire 9 into the groove 24 has been completed. At least one shearing tool 28 is secured to the periphery of the spool flange 7 and cooperates with a stationary shearing tool 29 located outside the reel in alignment with the rotating shearing tool 28. By means of this arrangement the projecting leading part of the advancing wire is cut off as soon as the wire is clamped in the groove 24 and the pressing roller 26 is actuated whereupon the pressing roller 26 is swung up, by means of a cylinder-and-piston arrangement 30, out of the winding range on the spool 5 and remains in the swung up position until the completion of the winding process.

Figure 3:
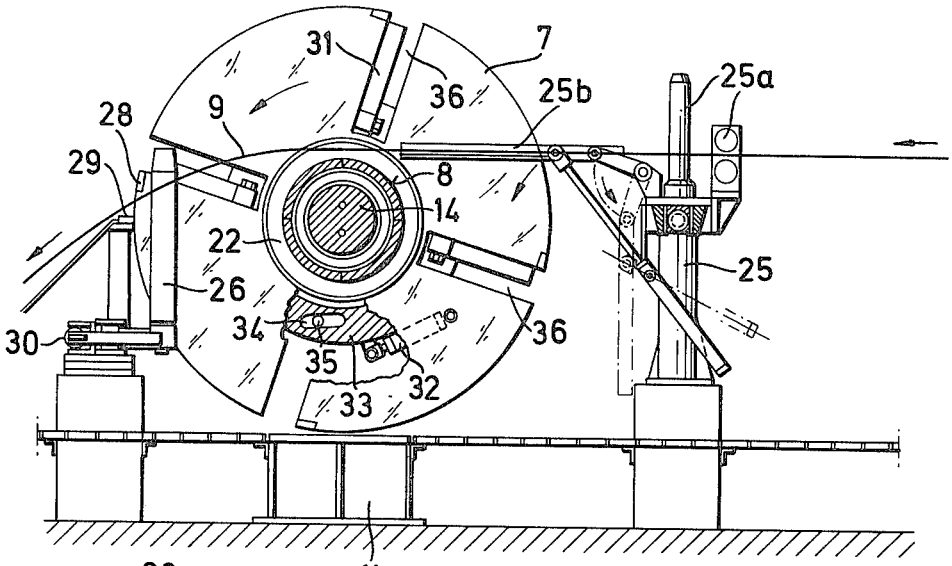
FIG. 3 is a sectional side view taken along line III—III in FIG. 2.

Referring now to FIG. 3, the flange 7 is provided with a plurality of radially directed slits 36 each accommodating a tiltably supported abutment lever 31. At the beginning of the winding process during the catching of the leading part of the wire 9 the levers 31 are in an inclined position in alignment with the sloping surface of the flange 7 so that the wire 9 might be guided by the inclined surface of the flange into the groove 24. As soon as the wire 9 has been clamped and its excessive part cut off by the shearing assembly 28 and 29, the abutment levers 31 are swung into an upright position relative to the axis of rotation of the spool so that both end sides of the wound wire are perpendicular to the spool core 8. The abutment levers 31 are actuated by piston-and-cylinder units 32 connected at one end to the flange 7 and at the other end to an adjustment ring 33 by means of groove and pin guides 34 and 35 that control the position of the levers 31.

In FIG. 3 it is shown also in greater detail the arrangement of shearing assembly 28 and 29 as well as the action of the pressing roller 26. The guiding device 25 includes guiding rollers 25*a* so that wire 9 can be laid on core 8 in any tangential direction. To facilitate the introduction of wire 9 into the catching groove 24, a guiding channel 25*b* cooperates during the initial winding phase with guiding rollers 25*a*. Upon clamping of the wire 9 in the groove 24, the guiding channel 25*b* is removed from the winding range of spool 5 as indicated by dash-dot lines. The radial slits 36 serve also for binding the completed wire roll prior to its removal from the spool core 8.

Figure 4:
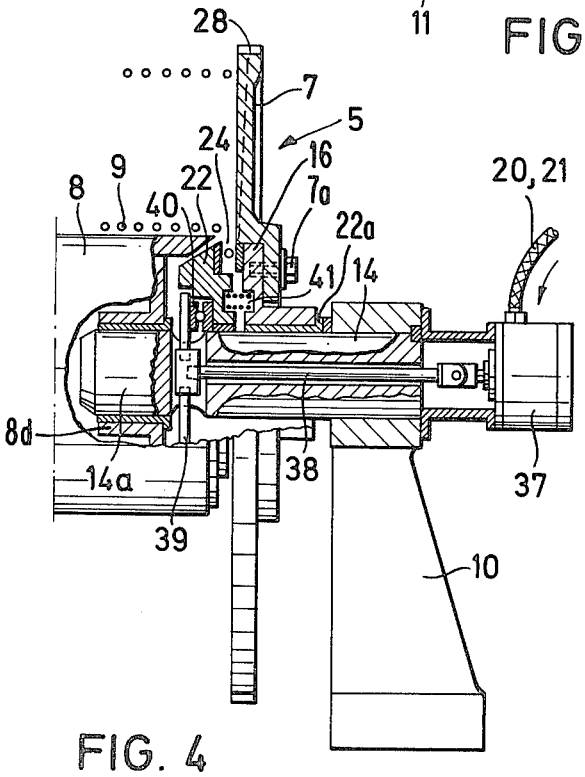
FIG. 4 is a detailed front view, partly in section, of a modification of the wire catching device and its actuating elements.
Figure 5:
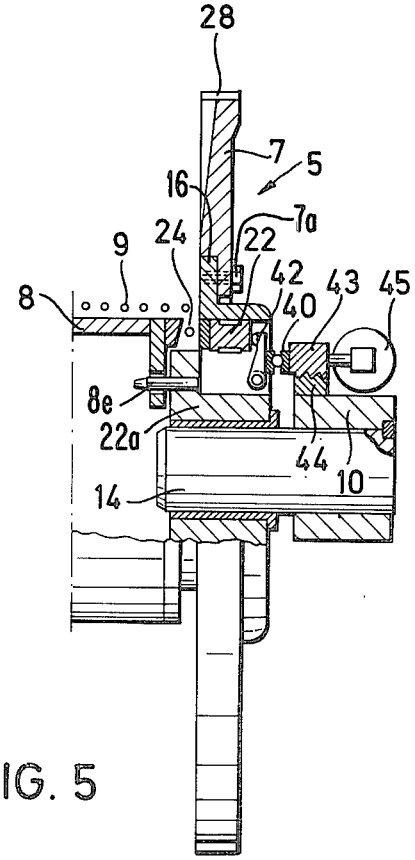
FIG. 5 is a sectional front view of still another modification of the catching device and its actuating elements in the reel of this invention.

In the embodiments shown in FIGS. 4 and 5 like parts are denoted by like reference numerals. In the modification of the wire catching and clamping device as shown in FIG. 4, clamping ring 22 is arranged on the opposite side than in the preceding embodiment and clamps wire 9 against the surface portion of the flange 7. The clamping ring 22 in this embodiment is slidably supported on the bearing pin 14 and actuated via a link 38 connected through the interior of the bearing pin 14 to a pressure fluid cylinder 37 that transfers its axial movements to the ring 22 via pressure arms 39 and ball bearing 40. A pressure spring 41 counteracts the pull of the cylinder 37 and axially displaces the clamping ring 22 as soon as pressure in conduits 20, 21 and cylinder 37 has been released. The springs 41 are preferably arranged at regular intervals below the catching groove 24. Rotation is transmitted between the core 8 and the spool flange 7 by a part 8*d* in which a portion 14*a* of the hub 14 is tightly received and further through the sleeve 22*a* which is received on the outer surface of the hub 14 onto the sleeve 16 which is received on the outer surface of the sleeve 22*a* and fixedly connected by a bolt 7*a* to the spool flange 7.

The clamping ring 22 may be actuated, for example via the link 38, by electro magnetic driving means. In this case, the reference numeral 37 disignates an electromagnet which is provided with an electric cable 20 which is connected to an electric source (not shown).

In the embodiment as shown in FIG. 5, the clamping ring 22 is moved into the catching groove 24 by means of levers 42 that are actuated via a ball bearing 40 surrounding the bearing pin 14. The axial position of the bearing 40 and of arms 42 is controlled by a threaded ring 43 rotatable on a threaded sleeve 44 secured to the bearing stand 10. A driving cylinder 45 is arranged for rotating the threaded ring 43 and consequently to change its axial position and at the same time to change the axial position of the clamping ring 22. A pin 8*e* is fixedly mounted on the sleeve 22*a* and projects into and through the flange 8*c* of the core 8 so as to transmit rotary movement therefrom onto the sleeve 22*a* which is received in the hole of the sleeve 16. Thus, the flange 7 rotates in response to rotary movement of the core 8 through the pin 8*e*, the sleeve 22*a*, and the sleeve 16 (which is rigidly connected, via the bolt 7*a*, to the flange 7).

The lever 42 is fixed to the ring 22. Thus, when the driving cylinder 45 reverses the rotary movement of the threaded ring 43, the lever 42 retracts the ring 22 from its clamping position, that is away from the core 8.

It will be understood that each of the elements described above, or two or more together, may also find a useful application in other types of constructions differing from the types described above.

Without further analysis, the foregoing will so fully reveal the gist of the present invention that others can by applying current knowledge readily adapt it for various applications without omitting features, that from the standpoint of prior art, fairly constitute essential characteristics of the generic or specific aspects of the present invention.

What is claimed as new and desired to be protected by Letters Patent is set forth in the appended claims:

1. An arrangement for winding a continuously fed wire, comprising a rotary spool having a core and a flange at one end of the core and spaced from said end of the core to form a wire receiving groove between the core and said flange;

means connecting said core and flange for joint rotation about an axis of the core, and wire clamping means movable in the axial direction and into the groove to clamp the wire introduced into the groove tangentially of the core and groove.

2. A combination as defined in claim 1, wherein said clamping means includes a clamping ring movable against one of the side walls of said groove.

3. A combination as defined in claim 2, wherein said moving means includes pressure fluid driving means for actuating said clamping ring.

4. A combination as defined in claim 1, wherein said clamping means includes electromagnetic driving means for axially displacing said clamping ring.

5. A combination as defined in claim 1, and further including a main driving unit connected to said other end of said core.

6. A combination as defined in claim 5, wherein said flange and said clamping means are rotatably supported on a stationary bearing pin.

7. A combination as defined in claim 6, wherein said bearing pin together with said flange and said clamping means are arranged for axial movement away from said core.

8. A combination as defined in claim 1, wherein the surface of said flange is sloping from the core outwardly.

9. A combination as defined in claim 8, wherein said flange carries on its periphery at least one shearing member cooperating with a stationary shearing member near said flange for cutting off the excessive wire projecting from said groove.

10. A combination as defined in claim 9, further including a pressing roller arranged for depressing the advancing wire against said sloping surface of said flange.

11. A combination as defined in claim 10, wherein said pressing roller is supported for movement out of the range of said spool.

12. A combination as defined in claim 8, wherein said flange includes a plurality of radial slits each accommodation a pivotal arm movable from an inclined position in alignment with said sloping surface of the flange to a working position at right angles to said core.

13. A combination as defined in claim 1, further including a removable guiding member for introducing said wire into said groove.

14. A combination as defined in claim 1, further including a second flange secured to the other end of said core, both flanges having a plurality of radial slits for use in binding the completed wire roll.

* * * * *